US006206217B1

(12) United States Patent
Chiang

(10) Patent No.: US 6,206,217 B1
(45) Date of Patent: Mar. 27, 2001

(54) PACKAGING CASE SET

(76) Inventor: Herman Chiang, 27-No. 634-9, Ching-Ping Rd., Taipei Hsien (TW)

( * ) Notice: Subject to any disclaimer, the term of this patent is extended or adjusted under 35 U.S.C. 154(b) by 0 days.

(21) Appl. No.: 09/472,767

(22) Filed: Dec. 27, 1999

(51) Int. Cl.[7] ..... B65D 6/02; A45C 11/04

(52) U.S. Cl. ..... 220/8; 206/5; 206/37; 220/4.21; 220/4.24

(58) Field of Search ..... 206/5, 37; 220/4.21, 220/4.24, 8

(56) References Cited

U.S. PATENT DOCUMENTS

| | | | | |
|---|---|---|---|---|
| 2,304,896 | * | 12/1942 | Doyle | 220/4.21 |
| 2,416,142 | * | 2/1947 | Bennett | 220/8 X |
| 2,762,411 | * | 9/1956 | Haskins | 220/4.24 X |
| 3,236,002 | * | 2/1966 | Cunningham et al. | 220/4.21 X |
| 3,901,406 | * | 8/1975 | Kivett | 220/8 |
| 4,393,974 | * | 7/1983 | Levesque | 206/37 |
| 4,519,497 | * | 5/1985 | Brinkers | 206/37 |
| 4,744,461 | * | 5/1988 | Laphan | 206/5 |
| 4,813,566 | * | 3/1989 | Hewitt | 220/4.24 |
| 5,074,426 | * | 12/1991 | Goodhart et al. | 220/4.24 |

* cited by examiner

*Primary Examiner*—Bryon P. Gehman
(74) *Attorney, Agent, or Firm*—Pro-Techtor Int'l Services

(57) ABSTRACT

A packaging case set, used for packing swimming goggles with a mono frame, including two pieces of packaging cases that have the same style case shell, and in which each of the packaging cases consists of a first and second enclosure, bonding unit etc. Therein, the first and second enclosures are inward arching and are then assembled to form a sealed space. Furthermore, each enclosure is equipped with a bonding unit, whereby the bonding unit contains the first and second fasteners, which further become fastened together accordingly. Owing to the above structure, and also by means of the fastening function in-between the first and second fasteners on the first enclosure, it can hence be reassembled into two different-styled packaging cases at the time of opening. Thus, it is ready for the packing of small personal items or complete set of swimming goods, such as swimming goggles, earplugs, nosepieces, etc.

14 Claims, 4 Drawing Sheets

PACKAGING CASE SET

FIELD OF THE INVENTION

The presented innovation is designed to provide a kind of packaging case set, and more particularly a case shell, which while being opened is able to be assembled with another opened case shell into two new style case shells. The packaging case set is thus able to form respective structures for the packing of swimming goggles, swimming goods, or small personal items.

BACKGROUND OF THE INVENTION

FIG. 1 gives reference to a packaging case related to the present invention, which is especially for the packing of swimming goggles as well. Moreover, the structure for such a kind of swimming goggles packaging case is not only very convenient, but is also able to securely protect the glasses. There are a variety of designs for known swimming goggles containers, but in fact most of them either lack innovative and functional designs, or maybe just concentrate on changes in visible appearance only, with very few of them having an improvement in functions. It is a common experience for most of us that there are no united and proper packaging cases to help us for the collection and packing of small personal items, such as earplugs, nosepieces, small ornaments etc., when we go swimming. As a result, swimming was becoming more and more inconvenient, sometimes even resulting in the unlucky loss of items, thus presenting the need for people who enjoy swimming to solve such a problem.

In addition, the design of swimming goggles eyeglasses have dramatically changed, from only having zero diopter eyeglasses, to the provision of services for both shortsighted and far sighted people; and, going further, they can even render special service for particular people in the supply of different diopters on both eyes. There is a tendency to be concerned with the service rendered to customers instead of technology. Under such circumstances, even the sales status for swimming goggles has also changed, from only purchasing mono eyeglasses instead of two eyeglasses at the same time. Therefore there's a rapid need for the improvement of both the style and the functions of the swimming goggles accordingly.

Thus, the purpose of the present invention is to provide a kind of packaging case set, in which each packaging case is used for the packing of mono frame swimming goggles. Meanwhile, it also allows each packaging case, while opened, to be reassembled with other opened packaging cases, for the forming of two new style case shells. One of the case shells is for collecting/packing, while the other case shell is for collecting/packing with earplugs, nosepieces, or small ornaments, offering a new style with multi-functions.

Another purpose of the present invention is to provide a brand new style in sales by offering the packaging case for mono frame swim glasses, hence allowing customers to select the options in accordance to their actual needs.

CHARACTERISTICS OF THE INVENTION

The major characteristics of the packaging case of the present invention include: each packaging case comprising of two pieces of packaging case with the same style case shell, in which each of the packaging cases consists of a first and second enclosure, bonding unit etc, wherein the first and second enclosure mesh with each other and are then assembled into a sealing space. Moreover, each enclosure is equipped with a bonding unit, in which the said bonding unit contains the first and second fasteners, which become further stuck to each other accordingly. Owing to the above structure, and also by means of the function of becoming stuck in-between the first and second fasteners on the first enclosure, it is hence able to be reassembled into two different-styled packaging cases at the time of opening the packaging case.

In compliance with the major characteristics, in which the first fastener is a fastening slot and the second fastener is a coupling post, there is also a securing protrusion equipped with the coupling post for the purpose of becoming stuck with the fastening slot.

The other characteristic of the packaging case of the present invention is that the join face formed by the marching in-between the first and second enclosure is the same in conformational structure. Additionally, in light of the above description, the join face formed by the inarching motion in-between the first and second enclosure is actually a wave shape.

Another characteristic of the packaging case of the present invention is the installation of a locator. Located at a position nearby the join face, on the first and second enclosure, it not only provides a special function in the mutual alignment while inarching, but also prevents the revolving of the join face across the curved surface after the inarching of the first and second enclosure.

Furthermore, one additional characteristic of the packaging case of the present invention is a tie-unit installed. This is not only able to tighten the combined piece caused by the first and second enclosures, but also offers a special function for hand carrying purposes.

The preferred embodiment of the present invention, its configuration, structure, and operation, is best further described in the following detailed description, taken in conjunction with reference to the accompanying drawings:

BRIEF DESCRIPTION OF NUMBERS

| | |
|---|---|
| Packaging CASE set | 1, 1', 1" |
| The first enclosure | 10 |
| The second enclosure | 11 |
| Bonding unit | 12 |
| Locator | 13 |
| Tie-unit | 14 |
| Join face | 101, 111 |
| Fastening slot | 121 |
| Coupling post | 122 |
| Securing protrusion | 123 |
| Annular slot | 141 |

-continued

| | |
|---|---|
| Perforation | 142 |
| Tie-band | 143 |
| Pressed sleeve | 144 |

DETAILED DESCRIPTION

Figure 1:
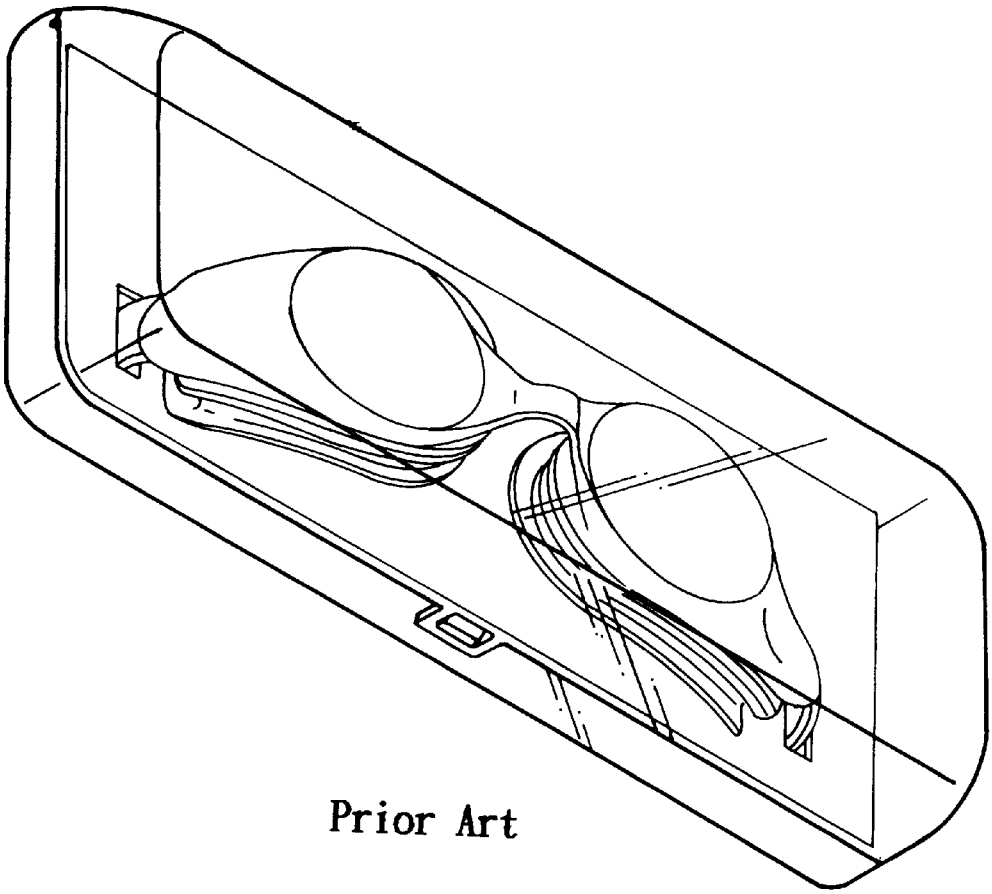
FIG. 1 is a perspective view of the known packaging case for swimming goggles.
Figure 2:
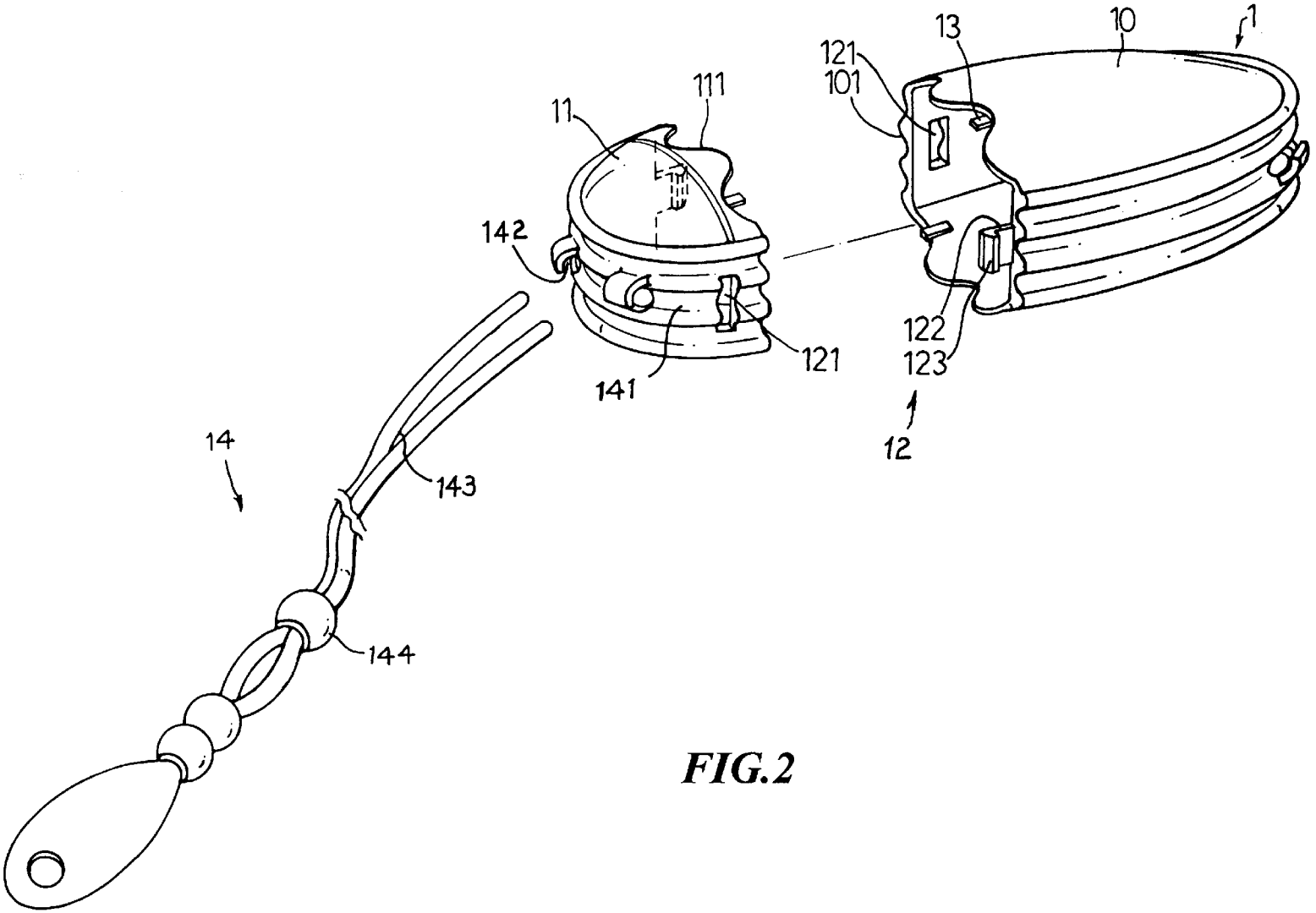
FIG. 2 is an exploded perspective view for the single packaging case of the packaging case set in accordance to the present invention.

With reference to FIG. 2, this figure is an exploded perspective view for the single packaging case of the packaging case set's present invention. Due to each packaging case, of the packaging case set's present invention, being the same shape and structure, therefore it is acceptable to illustrate only one of the packaging cases. As shown in FIG. 2, packaging case set 1 comprises of structures such as: the first enclosure 10, second enclosure 11, bonding unit 12, locator 13, tie-unit 14 etc. Herein, the shape of the first enclosure 10 and the second enclosure 11 are similar to a stereo-hollow semi-oval, the said first enclosure 10 is longer than the said second enclosure 11, and the join face 101, 111, inbetween the enclosures, is in the shape of a wave, resulting in the effect of contraposition. Moreover, inside the join face 101, 111 is installed with a locator 13 which is located on the malposition at the ribbing, extending from the first enclosure 10 and the second enclosure 11. In addition, the other end of the ribbing partly extends out of the join face 101, 111, in-between the first enclosure 10 and the second enclosure 11. By the time the first enclosure 10 and the second enclosure 11 bond together, it will possess the function of guiding and preventing the action of revolving.

The said bonding unit 12 consists of the first and second fastener, which allow mutual fastening. Therein, the first fastener is a fastening slot 121 and the second fastener is a coupling post 122, which are all equipped on the first and second enclosure 10, 11 and thereby the said coupling post 122 has an securing protrusion 123 for sticking with the said fastening slot 121. Owing to the shape and structure of the present invention's single packaging case being the same, therefore after opening the packaging case, the reassembled enclosures will all stick together to form one piece, by means of the fastening slot 121 and coupling post 122. In other words, the present inventions have a common design in the mutual fastening of different packaging cases without the limitation of orientation.

Figure 3:
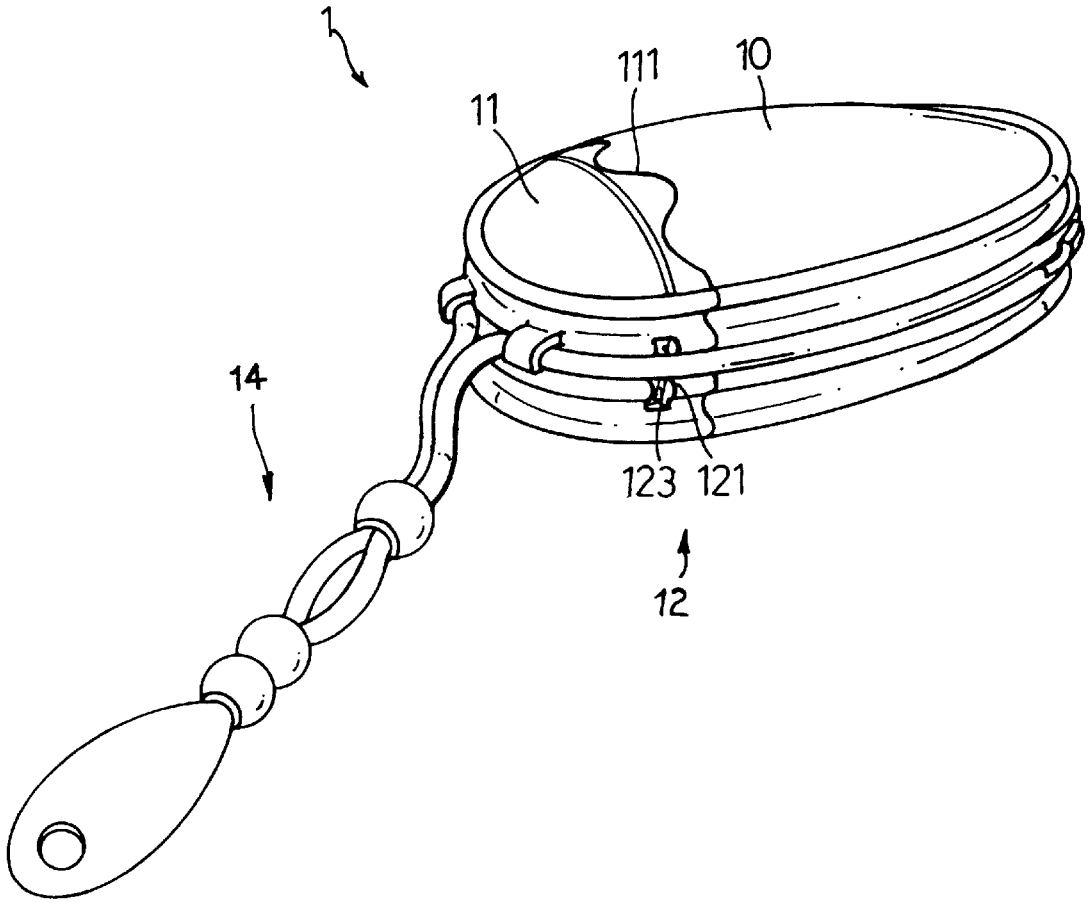
FIG. 3 is a schematic view of the single packaging case for the packaging of swimming goggles with a mono frame, as shown in FIG. 2, according to the preferred embodiment of the present invention.

Also, the said tie-unit 14 comprises of an annular slot 141, perforation 142, tie-band 143, and pressed sleeve 144, etc. The said annular slot 141 is positioned on the exterior macropinacoid of the first enclosure 10 and the second enclosure 11. The said perforation 142 is positioned at the bottom of the long axle of the said first enclosure 10 and the second enclosure 11, extending from the inside of the first enclosure 10 (or the second enclosure 11) and having the said perforation 142. There is a tie-band 143 stretching outward and then winding into the said annular slot 141, and once again is tied down at the proper position by the pressed sleeve 144 as a result. With reference to the FIG. 3, upon assembly, the said tie-band 143 will stretch out from the inside of the said enclosure through its perforation, and have a reef knot at the end that is inside the said enclosure. The tie-ban 143 will wind both the first and second enclosure around the annular slot 141, and then be pressed down by the pressed sleeve 144 on the tie-band 143 as a result. In this way the enclosures will be secured properly, while the extra length of the tie-band also acts as a hand-carrying band. Contrarily, if performing the procedure in reverse then it is possible for you to open it accordingly.

Figure 4:
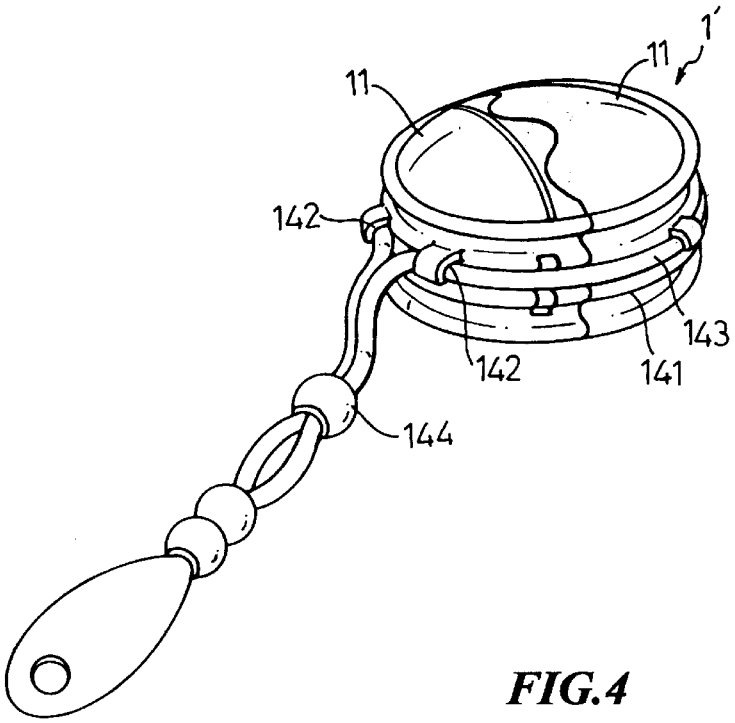
FIGS. 4 and 5 are schematic views of the new style-packaging case reassembled from two opened packaging cases in of the present invention.
Figure 5:
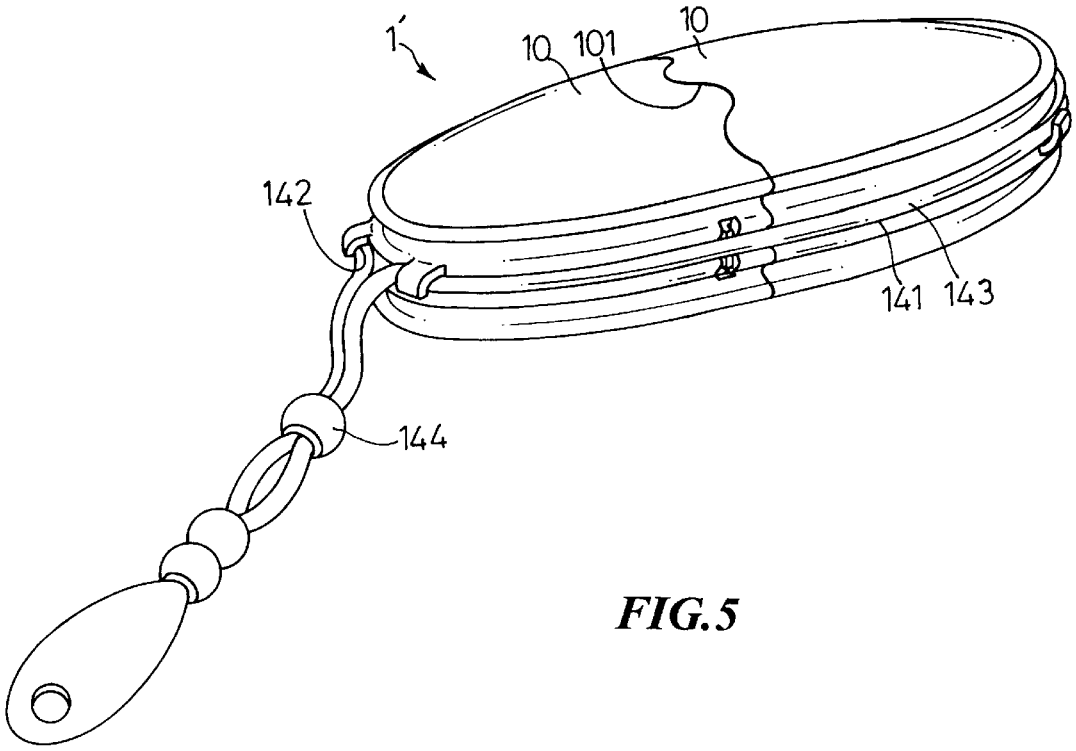

With reference to the FIGS. 4 and 5, these are schematic views of the new stylepackaging case, which are reassembled from two opened packaging cases of the present invention. Shown in FIG. 4 is a packaging case 1' reassembled from two first enclosures 10 for the collecting and packing of complete sets of swimming goggles; while FIG. 5 shows a packaging case 1" reassembled from two second enclosures 11, for the collecting and packing of small personal items such as earplugs, nosepieces, coins, keys, etc. Of course, it is also appropriate for the collecting and packing of small sets of cleaning goods.

In view of the specific embodiment described herein, while the present invention has been illustrated and described, it would be obvious to those skilled in the art that various other changes and modifications, such as equipping with an un-wave shaped join face for the packaging case, the use of other geometric figures for the conformation of enclosures, or even using the product for collecting and packing items other than swimming goggles, of the present invention, can be made without departing from the spirit and scope of the invention. Coverage of all such changes and modifications within the scope of the present invention are therefore intended in the appended claims.

I claim:

1. A packaging case set comprising:

a first packaging case and a second packaging case, each said packaging case comprises a first enclosure and a second enclosure; wherein said first enclosure and said second enclosure mesh together at a joining face to form an enclosed space, each said enclosure comprises a bonding unit, each said bonding unit comprising a fastening slot and a coupling post with a securing protrusion thereon, said coupling post being received in said fastening slot to secure said first enclosure to said second enclosure; and wherein said joining face is in a wave shape.

2. The packaging case set as recited in claim 1 wherein:

said first enclosure and said second enclosure each have an alignment means affixed thereto, said alignment means serving to align said first enclosure and said second enclosure during joining, and said alignment means further secure said first enclosure and said second enclosure in their respective positions.

3. The packaging case set as recited in claim 2, wherein:

a tie-unit is installed on said packaging case, said tie-unit serving to further secure said first and second enclosures, and said tie-unit also serves as a handle for hand carrying.

4. The packaging case set as recited in claim 3, wherein:

said alignment means is positioned near the joining face of said first and second enclosure, and said first enclosure and said second enclosure each include a rib extending from an outer surface at said joining face.

5. The packaging set as recited in claim 4 wherein:

said tie-unit comprises an annular slot, a perforation, a tie-band, and a pressed sleeve, said first enclosure and said second enclosure each have one of said annular slots on an exterior surface, said tie-band is extended outward from an interior of one of said enclosures and then is wound into said annular slot, and tied down by said pressed sleeve.

6. The packaging case set as recited in claim 5 wherein:

a volume of said first enclosure is larger than a volume of said second enclosure.

7. A packaging case set comprising:

a first packaging case and a second packaging case, each said packaging case comprises a first enclosure and a second enclosure; wherein said first enclosure and said second enclosure mesh together at a joining face to form an enclosed space, each said enclosure comprises a bonding unit, each said bonding unit comprising a first fastener and a second fastener, and said first enclosure and said second enclosure each have an alignment means affixed thereto, said alignment means serving to align said first enclosure and said second enclosure during joining, and said alignment means further secure said first enclosure and said second enclosure in their respective positions; and wherein said joining face is in a wave shape.

8. A packaging case set as recited in claim 7 wherein:

a tie-unit is installed on said packaging case, said tie-unit serving to further secure said first and second enclosures, and said tie-unit also serves as a handle for hand carrying.

9. A packaging case set as recited in claim 8 wherein:

said alignment means is positioned near the joining face of said first and second enclosures, and said first enclosure and said second enclosure each include a rib extending from an outer surface at said joining face.

10. A packaging case set as recited in claim 4 wherein:

said tie-unit comprises an annular slot, a perforation, a tie-band, and a pressed sleeve, said annular slot is positioned on the exterior of one of said enclosures, said tie-band is extended outward from an interior of the other one of said enclosures and then is wound into said annular slot, and tied down by said pressed sleeve.

11. A packaging case set as recited in claim 10 wherein:

a volume of said first enclosure is larger than a volume of said second enclosure.

12. A packaging case set comprising:

a first enclosure, a second enclosure, and a bonding unit, said first enclosure and said second enclosure mesh together at a joining face to form an enclosed space, said first enclosure and said second enclosure each include a bonding unit, said bonding unit comprising a fastening slot and a coupling post with a securing protrusion thereon, said coupling post being received in said fastening slot to secure said first enclosure to said second enclosure; wherein a volume of said first enclosure is larger than a volume of said second enclosure, and said joining face is in a wave shape.

13. The packaging case set as recited in claim 12 wherein:

said first enclosure and said second enclosure each have an alignment means affixed thereto, said alignment means serving to align said first enclosure and said second enclosure during joining, and said alignment means further secure said first enclosure and said second enclosure in their respective positions.

14. The packaging case set as recited in claim 13 wherein:

said tie-unit comprises an annular slot, a perforation, a tie-band, and a pressed sleeve, an annular slot is included on a surface of one of said enclosures, said tie-band is extended outward from an interior of the other one of said enclosures and then is wound into said annular slot and tied down by said pressed sleeve, said tie-unit also serving as a handle for hand carrying.

* * * * *